US009013382B2

(12) United States Patent
Do

(10) Patent No.: US 9,013,382 B2
(45) Date of Patent: Apr. 21, 2015

(54) LIQUID CRYSTAL DISPLAY DEVICE AND METHOD FOR DRIVING THE SAME

(75) Inventor: Gun Woo Do, Daegu-si (KR)

(73) Assignee: LG Display Co., Ltd., Seoul (KR)

( * ) Notice: Subject to any disclaimer, the term of this patent is extended or adjusted under 35 U.S.C. 154(b) by 1216 days.

(21) Appl. No.: 11/581,651

(22) Filed: Oct. 16, 2006

(65) Prior Publication Data

US 2007/0285363 A1 Dec. 13, 2007

(30) Foreign Application Priority Data

Jun. 8, 2006 (KR) ..... 2006-51449

(51) Int. Cl.
*G09G 3/36* (2006.01)

(52) U.S. Cl.
CPC ..... *G09G 3/3655* (2013.01); *G09G 2310/0245* (2013.01); *G09G 2320/0257* (2013.01); *G09G 2330/027* (2013.01)

(58) Field of Classification Search
None
See application file for complete search history.

(56) References Cited

U.S. PATENT DOCUMENTS 4,490,626 A * 12/1984 Carlson ..... 327/408
6,069,620 A * 5/2000 Nakamura et al. ..... 345/214
2001/0020928 A1* 9/2001 Yanagisawa et al. ..... 345/98
2002/0057247 A1* 5/2002 Lee et al. ..... 345/88
2002/0080133 A1* 6/2002 Eu ..... 345/212
2004/0104908 A1* 6/2004 Toyozawa et al. ..... 345/211
2004/0140958 A1 7/2004 Tsai et al.
2004/0263446 A1* 12/2004 Kawase et al. ..... 345/87
2005/0231501 A1* 10/2005 Nitawaki ..... 345/211
2006/0066550 A1* 3/2006 Huang et al. ..... 345/92

FOREIGN PATENT DOCUMENTS

CN 1734533 A 2/2006
KR 1020020042403 A 6/2002
KR 1020020050809 A 6/2002
KR 1020040019207 A 3/2004

OTHER PUBLICATIONS

Office Action issued in corresponding Chinese Patent Application No. 2006101380304; issued Oct. 10, 2008.
Office Action issued in corresponding Korean Patent Application No. 10-2006-0051449, mailed Feb. 13, 2013.

* cited by examiner

*Primary Examiner* — Jesus Hernandez
(74) *Attorney, Agent, or Firm* — Brinks Gilson & Lione

(57) ABSTRACT

A LCD device includes a liquid crystal panel and a control circuit. The liquid crystal panel is configured to display an image in response to various received signals, one of which may include a common voltage signal. The control circuit receives a control signal. In response to the control signal, the control circuit couples the liquid crystal panel to the common voltage signal or to a ground voltage.

5 Claims, 5 Drawing Sheets

LIQUID CRYSTAL DISPLAY DEVICE AND METHOD FOR DRIVING THE SAME

BACKGROUND OF THE INVENTION

1. Priority Claim

This application claims the benefit of priority from Korean Patent Application No. 5149/2006, filed Jun. 8, 2006, which is incorporated by reference.

2. Technical Field

The present invention relates to a liquid crystal display device (LCD), and more particularly, to an LCD capable of reducing a discharging phenomenon.

3. Related Art

A cathode ray tube (CRT) can be heavy and large-sized. Therefore, a flat panel display device to overcome drawbacks of the CRT is under active development. The flat panel display device includes liquid crystal display devices (LCDs), field emission displays (FEDs), plasma display panels (PDPs), electro-luminescence (EL) display devices, etc.

FIG. 1 is a schematic view of a related art LCD. In FIG. 1, a power supply unit 11 generates and/or supplies various voltages. The power supply unit 11 may generate and/or supply a power voltage $V_{CC}$, a reference voltage $V_{DD}$, and a gate voltage $V_g$. The power voltage $V_{CC}$ drives a timing controller 1, a gate driver 3, and a data driver 5. The reference voltage $V_{DD}$ is used by the common voltage generating unit 13 to generate a common voltage $V_{com}$. The gate voltage $V_g$ is supplied to a liquid crystal panel 7 via the gate driver 3.

The timing controller 1 receives the power voltage signal $V_{CC}$ and generates a control signal for controlling the gate driver 3 and the data driver 5. In response to a control signal, the gate driver 3 supplies the gate voltage $V_g$ to the liquid crystal panel 7. Additionally, in response to the control signal, the data driver 5 supplies a predetermined data voltage to the liquid crystal panel 7. In response to the reference voltage $V_{DD}$ supplied from the power supply unit 11, the common voltage generating unit 13 generates the common voltage $V_{com}$. The common voltage $V_{com}$ is supplied to the liquid crystal panel 7. Based on an electric potential difference between the data voltage and the common voltage, the liquid crystal panel 7 displays an image.

The operation of the LCD may be controlled by a power switch 9. The power switch 9 may couple an external power source to the power supply unit 11. When the power switch 9 is turned on, external power $V_{CC}$ is supplied to the power supply unit 11 and an image can be displayed on the liquid crystal panel 7. On the contrary, when the power switch 9 is turned off, the external power $V_{CC}$ is not supplied to the power supply unit 11. When the external power $V_{CC}$ is not supplied to the power supply unit 11, the power supply unit 11 cannot generate and/or supply the various voltages to the timing controller 1, the data driver 5, the gate driver 3, and the common voltage generating unit 13. Upon removal of the external power $V_{CC}$, the liquid crystal panel 7 will discharge over a period of about several seconds, and the liquid crystal panel 7 will eventually stop displaying an image.

In FIG. 2, when the power switch 9 is turned off, the common voltage $V_{com}$ supplied to the liquid crystal panel 7 is gradually discharged to a ground voltage due to a resistance and a capacitance of the liquid crystal panel 7. This discharge occurs over a period of about several seconds. Therefore, although the power switch 9 is turned off, a residual voltage remains on the liquid crystal panel 7, and thus a discharging phenomenon can occur. The discharging phenomenon can create an abnormal image that is displayed on the liquid crystal panel 7 which reduces image quality and degrades the product quality of the liquid crystal device.

Therefore, there is a need for an LCD that is capable of reducing a discharge phenomenon and improving image quality.

SUMMARY OF THE INVENTION

A LCD device includes a liquid crystal panel and a control circuit. The liquid crystal panel is configured to display an image in response to various received signals, one of which may include a common voltage signal. The control circuit receives a control signal. In response to the control signal, the control circuit couples the liquid crystal panel to the common voltage signal or to a ground voltage.

Other devices, systems, methods, features, and advantages will be, or will become apparent to one with skill in the art upon examination of the following figures and detailed description. It is intended that all such additional devices, systems, methods, features, and advantages be included in this description, be within the scope of the invention, and be protected by the following claims.

BRIEF DESCRIPTION OF THE DRAWINGS

The device, system, and methods may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
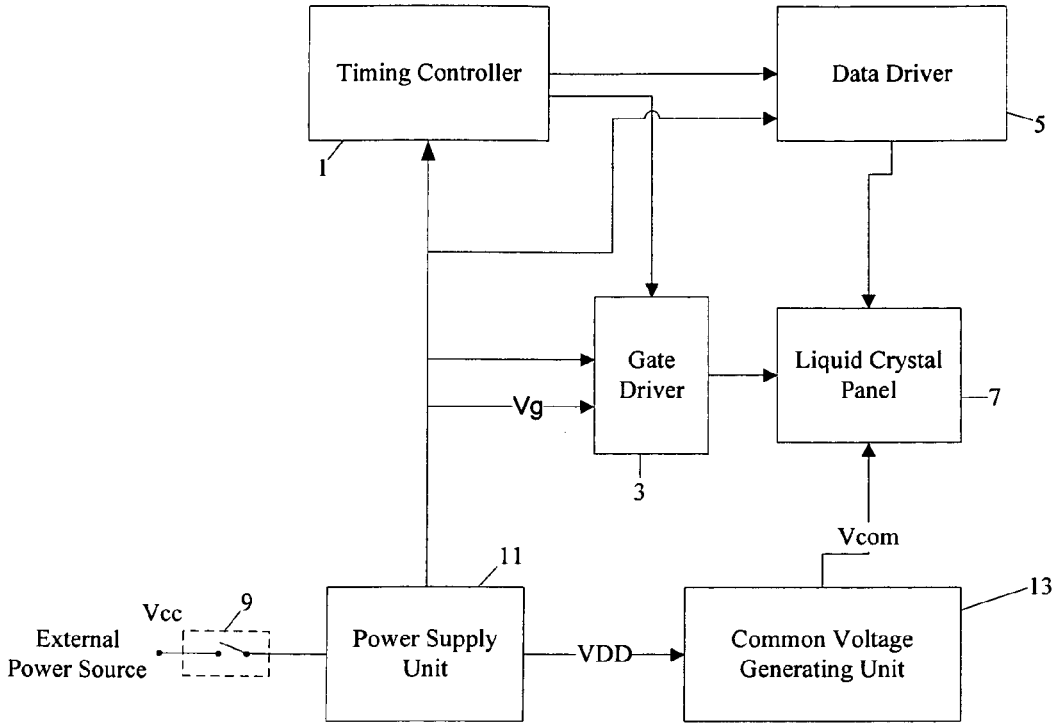
Fig. 1 (Related Art)
FIG. 1 is a schematic view of a related art liquid crystal display (LCD) device.
Figure 2:
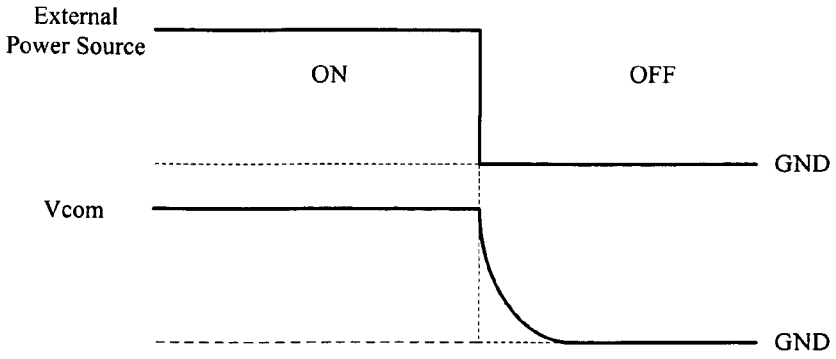
Fig. 2 (Related Art)
FIG. 2 is a waveform diagram illustrating a change in a common voltage supplied to a liquid crystal panel in the LCD of FIG. 1.
Figure 3:
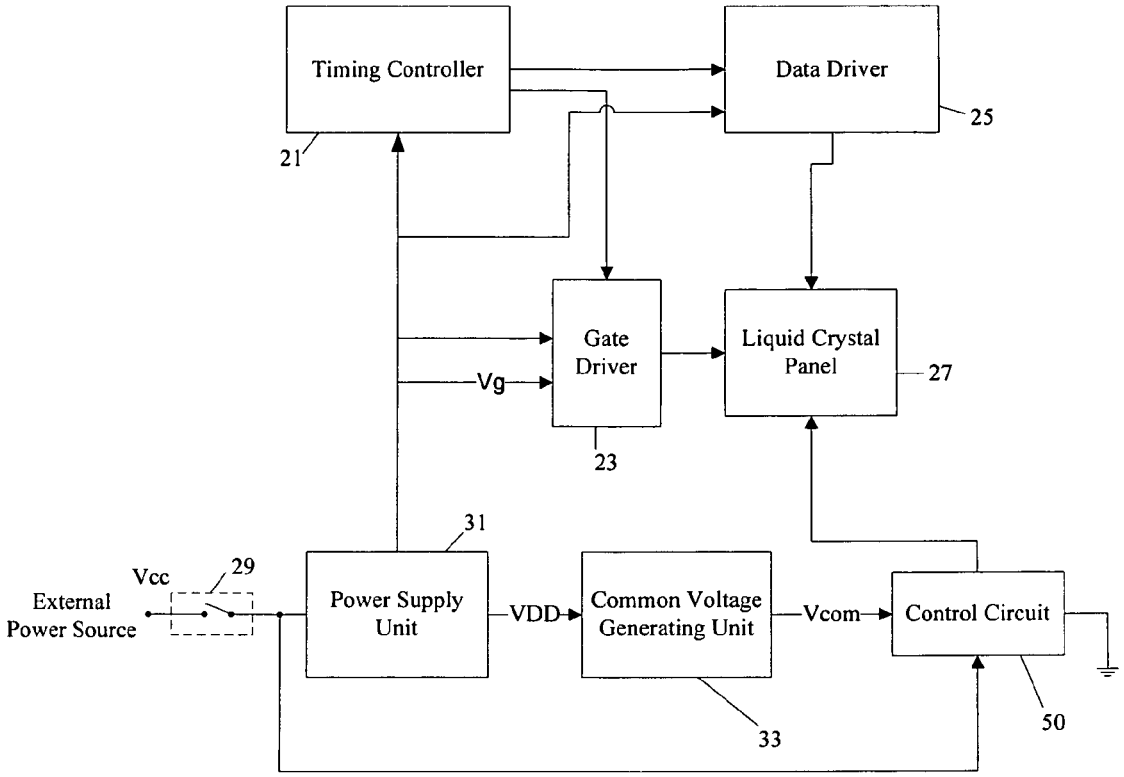
FIG. 3 is a schematic view of an LCD coupled to a control circuit.

FIG. 3 is a schematic view of an LCD coupled to a control circuit. In FIG. 3, external power is supplied or not supplied to a power supply unit 31 according to the switching of a power switch 29. When the power switch 29 is turned on, the external power $V_{CC}$ is supplied to the power supply unit 31. On the contrary, when the power switch 29 is turned off, the external power is not supplied to the power supply unit 31.

The external power $V_{CC}$ may be used as a control signal for a control circuit 50. The control circuit 50 may selectively couple a common voltage $V_{com}$ or a ground voltage to a liquid crystal display panel 27.

The power supply unit 31 supplies and/or generates various voltages which can be used to drive other devices. In FIG. 3, the power supply unit 31 supplies and/or generates a power voltage $V_{CC}$ for driving a timing controller 21, a gate driver 23, a data driver 25, and a common voltage generating unit 33. A reference voltage $V_{DD}$ is supplied to the common voltage generating unit 33 which generates a common voltage $V_{com}$. A gate voltage $V_g$ is supplied to the gate driver 23 which may in turn be supplied to the liquid crystal panel 27.

The timing controller 21 generates a control signal for controlling the gate driver 23 and the data driver 25. The gate driver 23 supplies the gate voltage $V_g$ to the liquid crystal panel 27 in response to the control signal. The data driver 25 supplies a predetermined data voltage to the liquid crystal panel 27 in response to the control signal.

The liquid crystal panel 27 can be formed by attaching first and second substrates with a liquid crystal layer interposed therebetween. In the first substrate, a plurality of gate lines and a plurality of data lines are arranged to intersect each other, a thin film transistor (TFT) is connected to each of the gate lines and the data lines, and a pixel electrode is connected to the TFT. The gate lines and the data lines define pixel regions. The TFT and the pixel electrode are formed in each of the pixel regions. Red, green, and blue color filters are formed in the second substrate to correspond to the pixel region. A common electrode may be formed in one of the first and second substrates.

The common voltage generating unit 33 generates the common voltage $V_{com}$. The common voltage $V_{com}$ may be generated from the reference voltage $V_{DD}$ supplied from the power supply unit 31. The common voltage generating unit 33 may supply the common voltage $V_{com}$ to the liquid crystal panel 27. The control circuit 50 selectively supplies the $V_{com}$ voltage to the liquid crystal panel.

The control circuit 50 may include multiple input and output terminals. In FIG. 3, the control circuit 50 includes two input voltage terminals, and an output terminal. One input voltage terminal is connected to an output of the common voltage generating unit 33 while the other input voltage terminal is connected to a ground terminal. The output of the control circuit 50 is coupled to the common electrode of the liquid crystal panel 27. Based on a received control signal, the control circuit 50 selectively couples one of the input terminals to the circuit's output terminal.

In FIG. 3, the control circuit is switched in response to a control signal. A signal representing the external power $V_{CC}$ directly applied from the external power source may be used as the control signal. Additionally, the control circuit 50 may generate a delayed external power $V_{CC}$ signal and use this delayed signal to control which input voltage terminal is coupled to the circuit's output terminal. The delayed external power signal may be a signal representing the direct external power $V_{CC}$ delayed by a period of time. The delayed signal may be realized through the use of a buffer, an RC delay circuit, or through various other delay devices.

Figure 4:
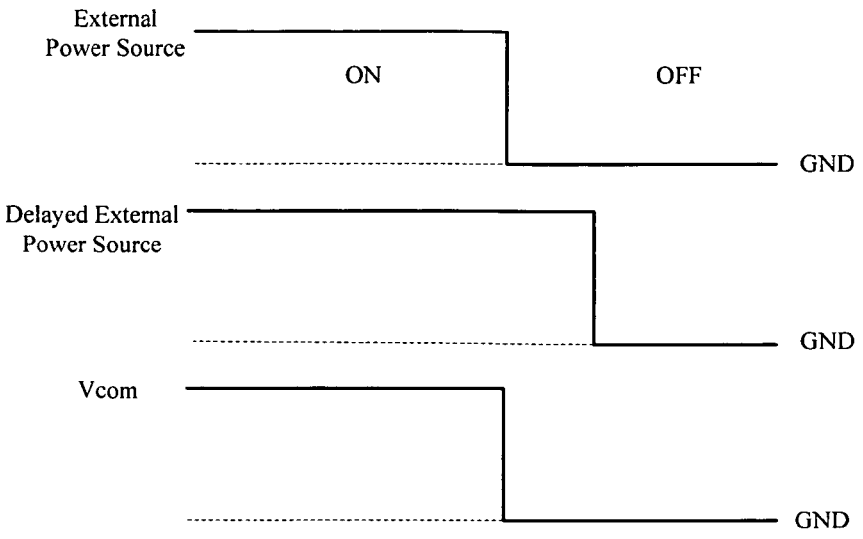
FIG. 4 is a waveform diagram illustrating a change in a common voltage supplied to a liquid crystal panel in the LCD of FIG. 3.

FIG. 4 is a waveform diagram illustrating a change in a common voltage supplied to a liquid crystal panel in the LCD device of FIG. 3. In FIG. 4, when the external power $V_{CC}$ switches from a high level to a low level, the delayed external power signal remains at a high level for a delayed period of time before transitioning to a low level.

The control circuit 50 may select an input voltage terminal according to the presence of a control signal or an "on/off" state of a power switch 29. When the control signal, such as the external power $V_{CC}$ signal, is at a high level, the control circuit 50 couples the $V_{com}$ signal to the liquid display panel 27, and an image may be displayed on the liquid crystal display panel 27 according to an electrical potential difference between the data voltage and the common voltage $V_{com}$. When the control signal is at a low level, or the power switch 29 is opened, the whole system is turned off, and thus the control circuit 50 does not receive a control signal.

Depending on the configuration of the control circuit 50, the control circuit 50 may use one or more signals to control an operation of a liquid crystal display panel 27. In a first configuration, the control circuit 50 receives a control signal and also generates a delayed version of the control signal. The control signal may be the external power $V_{CC}$ signal. In the first configuration, when the control signal is the external power $V_{CC}$ signal, and the external power signal transitions from a high level to a low level, the control circuit 50 generated delayed power signal remains at a high level for a time period equal to the delay period. During this time period, the control circuit 50 may use the power supplied from the delayed power signal to couple the liquid crystal display panel 27 to ground. Coupling the liquid crystal display panel 27 to ground causes the liquid crystal display panel 27 to discharge at a faster rate. The discharge rate may be about 0.5 seconds. Discharging the liquid crystal display panel 27 to ground can reduce a residual voltage discharging phenomenon and improve the quality of an image displayed on the liquid crystal display panel 27.

Figure 5:
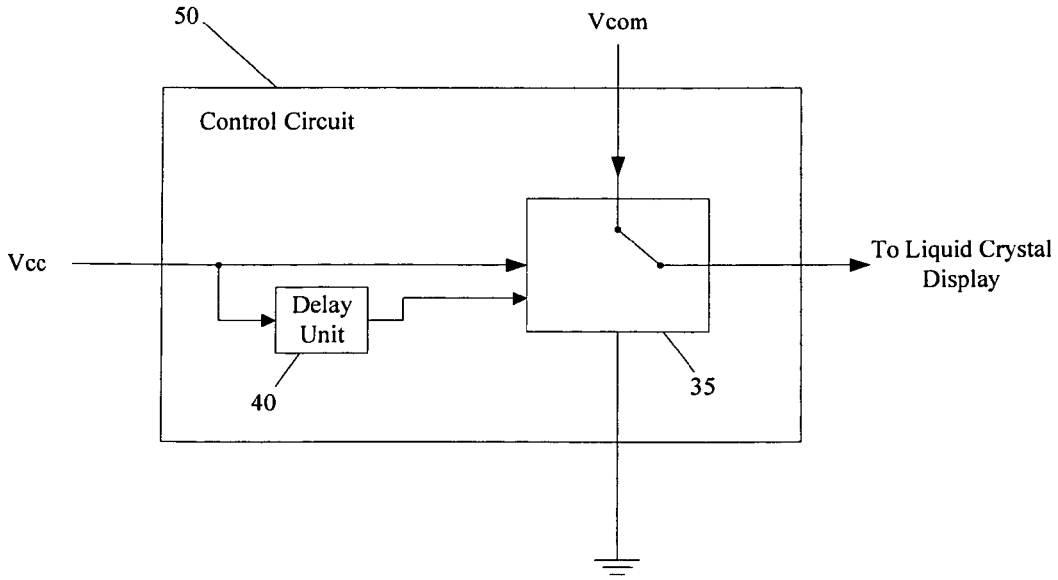
FIG. 5 is a schematic of a control circuit in a first configuration.

FIG. 5 is a schematic of the control circuit 50 in a first configuration. In a first configuration, the control circuit 50 may include a delay unit 40 and a common voltage switch 35. The delay unit 40 may receive a control signal. In FIG. 5, the control signal is the external power $V_{CC}$ signal. The delay unit 40 may delay the received control signal through a buffer, a resistive-capacitive (RC) delay circuit, or through various other display devices. The delayed and undelayed signals, as well as the $V_{com}$ signal, are supplied to the common voltage switch 35. Based on the values of the delayed and undelayed signals, the common voltage switch 35 may couple an output terminal connected to the liquid crystal display panel 27 to either the $V_{com}$ signal or ground.

Figure 6:
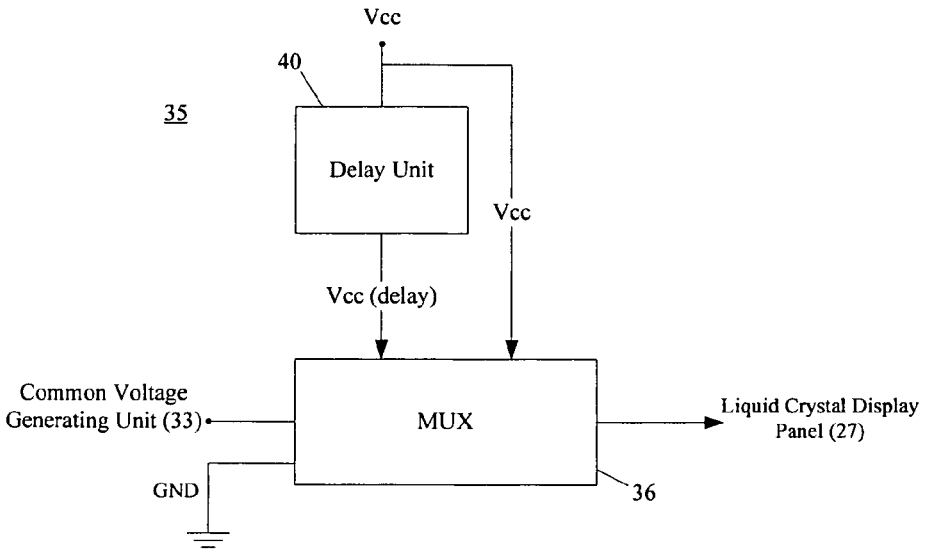
FIG. 6 is a schematic of a switch used with a control circuit's first configuration.

FIG. 6 is a schematic of a common voltage control switch which may be used with the control circuit 50 in a first configuration. In FIG. 6, a common voltage control switch 35 may be a multiplexer (MUX) 36. In response to a delayed and undelayed control signal, the multiplexer 36 couples an output terminal to one of a common voltage $V_{com}$ generated in a common voltage generating unit 33 or a ground voltage GND.

Figure 7:
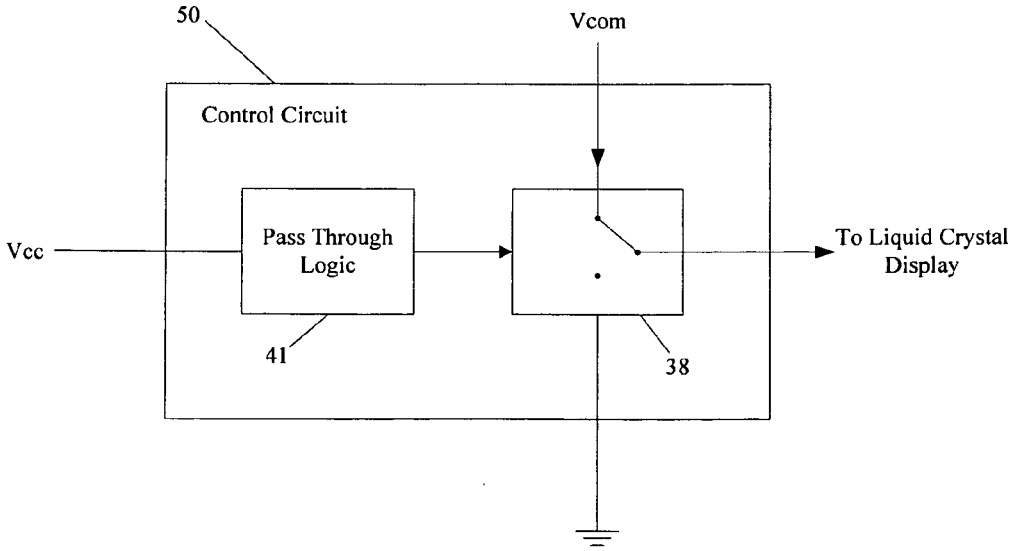
FIG. 7 is a schematic of a control circuit in a second configuration.

FIG. 7 is a schematic of the control circuit 50 in a second configuration. In a second configuration, the control circuit 50 may include a pass through logic circuit 41 and a common voltage switch 38. A control signal is supplied to the control circuit 50 in a second configuration. The control signal may be the external power $V_{CC}$ signal. The control signal is received by the pass through logic circuit 41 which may supply the control signal to the common voltage switch 38 with little or no change in the signal. The common voltage switch 38 may also be coupled to a ground line, and be coupled to a line that may supply a voltage signal, such as the $V_{com}$ signal. When the control signal is received by the common voltage switch 38, the switch is configured to supply the $V_{com}$ signal to the liquid crystal display panel 27. When the control signal is absent, the common voltage switch 38 is configured to couple the liquid crystal display panel 27 to ground. Coupling the liquid crystal display panel 27 to ground causes the liquid crystal display panel 27 to discharge at a faster rate. The discharge rate may be about 0.5 seconds. Discharging the liquid crystal display panel 27 to ground can reduce a residual voltage discharging phenomenon and improve the quality of an image displayed on the liquid crystal display panel 27. Alternatively, some control circuits 50 in a second configuration may not use a pass through logic circuit 41.

Figure 8:
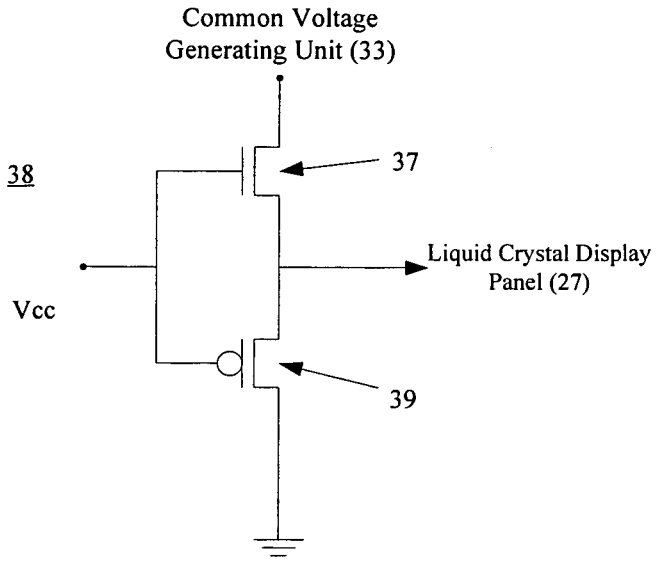
FIG. 8 is a schematic of a switch used with a control circuit's second configuration.

FIG. 8 is a schematic of a common voltage switch 38 used in a control circuit 50 in a second configuration. In FIG. 8, a common voltage control switch 38 may be a complementary metal oxide semiconductor (CMOS) transistor. The CMOS transistor includes first and second transistors 37 and 39 connected to each other in series between a common voltage generating unit 33 and a ground terminal. Each of the first and second transistors 37 and 39 may be a PMOS transistor or an NMOS transistor configured such that the first and second transistors 37 and 39 are alternately switched. For instance, the first transistor 37 may be a NMOS transistor that is turned on when a second transistor 39, such as a PMOS transistor, is turned off. Both of the first and second transistors 37 and 39 may receive a common control signal. The control signal may be a common voltage $V_{CC}$ signal.

The first transistor 37 includes a source terminal connected to an output terminal of the common voltage generating unit 33, a gate terminal connected to a control signal $V_{CC}$, and a drain terminal connected to a common electrode of a liquid crystal panel 27. The second transistor 39 includes a source terminal connected to the common electrode of the liquid crystal panel 27, a gate terminal connected to the control signal, such as the external power $V_{CC}$ signal, and a drain terminal connected to a ground terminal.

When the control signal, the external power $V_{CC}$ signal, is at a high level, the first transistor 37 is turned on and the second transistor 39 is turned off. In this configuration, a common voltage $V_{com}$ generated in the common voltage generating unit 33 is supplied to the common electrode of the liquid crystal panel 27 through the first transistor 37.

When the control signal, such as the external power $V_{CC}$ signal, is at a low level, the first transistor 37 is turned off and the second transistor 39 is turned on. In this configuration, a ground voltage GND is supplied to the common electrode of the liquid crystal panel 27 through the ground terminal and the second transistor 39. In FIG. 6, the control signal $V_{CC}$ may be the external power of FIG. 3.

Figure 9:
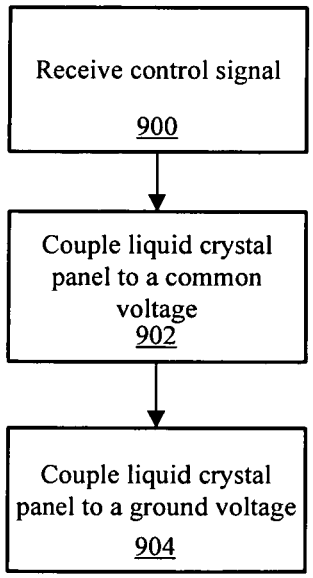
FIG. 9 is a process of driving an LCD.

FIG. 9 is a process of driving an LCD. At act 900 a control signal is received. The control signal may be received by a control circuit. The control signal may be a voltage signal. The control signal may represent the voltage level of an external power source. In some configurations, the control circuit may use the control signal to generate additional signal, such as a delayed control. At act 902, the control circuit couples the liquid crystal display panel to a common voltage.

At act 904, the control circuit couples the liquid crystal display panel to ground in response to a state change of the control signal. The control circuit may analog and/or digital circuitry to determine a state change of the control signal.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A liquid crystal display (LCD) device comprising:

a liquid crystal panel configured to display an image in response to an external power signal;

a power switch configured to supply the external power signal to a common voltage generating unit, the common voltage generating unit generating and applying a common voltage to the liquid crystal panel; and a control circuit coupled to the liquid crystal panel and comprising a common voltage switch that selectively couples the common voltage or a ground voltage to the liquid crystal panel based on ON or OFF state of the power switch, and a delay unit connected to the common voltage switch, delaying the external power signal a predetermined amount of time and outputting a delayed external power signal such that when the power switch is in the OFF state, the delayed external power signal for driving the common voltage switch is provided to the common voltage switch, wherein the control circuit couples the common voltage to the liquid crystal panel when the power switch is in the ON state and the external power signal is supplied to the common voltage generating unit and the control circuit, and wherein the delayed external power signal provides power to the common voltage switch to couple the ground voltage to the liquid crystal panel when the power switch is in the OFF state and no external power signal is supplied to the common voltage generating unit and the control circuit such that a residual common voltage of the liquid crystal panel is discharged upon termination of the external power signal, wherein an output terminal of the common voltage generating unit is directly connected to a common electrode of the liquid crystal panel when the power switch is in the ON state, wherein a ground voltage terminal is directly connected to a common electrode of the liquid crystal panel when the power switch is in the OFF state, wherein the external power signal is provided from a node between the power switch and the common voltage generating unit to the control circuit.

2. The LCD of claim 1, wherein the common voltage switch comprises a multiplexer, the multiplexer coupled to the liquid crystal display panel.

3. The LCD of claim 2, wherein the multiplexer is selectively coupled to the ground voltage.

4. The LCD of claim 1, wherein the common voltage switch comprises a CMOS transistor, wherein the CMOS transistor comprises first and second transistors connected to each other in series between the common voltage generating unit and a ground voltage terminal, wherein the first and second transistors are alternately switched.

5. The LCD of claim 4, wherein the CMOS transistor is selectively coupled to the ground voltage.

* * * * *